US006711101B2

(12) United States Patent
Bornovski

(10) Patent No.: US 6,711,101 B2
(45) Date of Patent: Mar. 23, 2004

(54) SEGMENTED DISPLAY AND TIMEPIECES USING SAME

(76) Inventor: Navot Bornovski, P.O. Box 142, Koror (PW), 96940

( * ) Notice: Subject to any disclaimer, the term of this patent is extended or adjusted under 35 U.S.C. 154(b) by 0 days.

(21) Appl. No.: 10/190,041

(22) Filed: Jul. 5, 2002

(65) Prior Publication Data

US 2003/0026090 A1 Feb. 6, 2003

Related U.S. Application Data

(60) Provisional application No. 60/305,991, filed on Jul. 16, 2001.

(51) Int. Cl.[7] ..... G04B 19/00; G04B 19/30; G04C 19/00

(52) U.S. Cl. ..... 368/223; 368/67; 368/68; 368/82; 368/242

(58) Field of Search ..... 368/67–70, 76, 368/82–84, 223, 239, 242

(56) References Cited

U.S. PATENT DOCUMENTS

| | | | | | |
|---|---|---|---|---|---|
| 3,647,279 | A | | 3/1972 | Sharpless et al. | |
| 3,757,511 | A | * | 9/1973 | Burgess et al. | 368/83 |
| 3,772,874 | A | * | 11/1973 | Lefkowitz | 368/242 |
| 3,802,945 | A | | 4/1974 | James | |
| 3,980,300 | A | | 9/1976 | Hornsby | |
| 4,009,381 | A | | 2/1977 | Schreiber et al. | |
| 4,130,987 | A | | 12/1978 | Schickedanz | |
| 4,385,842 | A | * | 5/1983 | Wiesner | 368/242 |
| 4,390,287 | A | * | 6/1983 | Morishige | 368/240 |
| 4,444,515 | A | * | 4/1984 | Clark | 368/279 |
| 4,752,919 | A | * | 6/1988 | Clark | 368/223 |
| 4,817,064 | A | * | 3/1989 | Milles | 368/282 |
| 4,932,147 | A | | 6/1990 | David | |
| 5,008,870 | A | * | 4/1991 | Vessa | 368/242 |
| 5,204,846 | A | * | 4/1993 | Brahaney | 368/228 |
| 5,214,624 | A | * | 5/1993 | Siebrasse | 368/82 |
| 5,420,570 | A | * | 5/1995 | Leitten et al. | 340/574 |
| 5,526,327 | A | * | 6/1996 | Cordova, Jr. | 368/82 |
| 5,553,735 | A | | 9/1996 | Kimura | |
| 5,995,456 | A | * | 11/1999 | Brewer et al. | 368/84 |
| RE36,662 | E | * | 4/2000 | Galison | 368/18 |
| 6,050,695 | A | | 4/2000 | Fromm | |
| 6,174,075 | B1 | | 1/2001 | Fuwausa | |
| 6,216,490 | B1 | | 4/2001 | Radley-Smith | |
| 6,223,559 | B1 | | 5/2001 | Coleman | |

* cited by examiner

*Primary Examiner*—David Martin
*Assistant Examiner*—Michael L. Lindinger
(74) *Attorney, Agent, or Firm*—David Pressman

(57) ABSTRACT

A system for providing electronic jewelry and telling the time of day includes binary display beads (105, 110) or segmented display beads (600, 700) arranged on a necklace or bracelet. In one embodiment, binary display beads successively indicate passage of hours of the day. In another embodiment, segmented display beads indicate the exact time in either moving band format or bar-graph format. A power source and timekeeping circuitry (not shown) are concealed within non-display beads (120, 122) or within the display beads.

20 Claims, 4 Drawing Sheets

TIME = 1 O'CLOCK HOUR

TIME = 1 O'CLOCK HOUR

TIME = 2 O'CLOCK HOUR

TIME = 3 O'CLOCK HOUR

TIME = 3:36:00 O'CLOCK

TIME = 4:36:00 O'CLOCK

TIME = 9:23:06 O'CLOCK

SEGMENTED DISPLAY AND TIMEPIECES USING SAME

CROSS-REFERENCE TO RELATED APPLICATIONS

This application claims the benefit of Provisional Patent Application Ser. No. 60/305,991, Filed Jul. 16, 2001.

FEDERALLY SPONSORED RESEARCH

None

BACKGROUND OF THE INVENTION

1. Field of Invention

This invention relates generally to displays and time keeping, and in particular to artful displays which can include the time of day.

2. Prior-Art

Many displays and ornaments are known in the field of jewelry, but these mainly have been limited to the use of fixed gemstones, colored glass (paste), and the like. Electronic displays are known but these are generally flat and relatively prosaic.

Numerous decorative methods for displaying the time of day have been employed in the past. For example, in U.S. Pat. No. 4,130,987 (1978), Schickendanz teaches a watch comprising a series of display element segments dispersed all over the surface of a bangle. Individual segments display images or characters representative of the time of day, the day of the week, the date, and so forth. Information is displayed all around the circumference of Schickendanz's device. In some cases, this requires the user to look at more than one point around the circumference in order to tell the time of day. This is a distinct disadvantage when compared with other timepieces which deliver all information at a glance.

Coleman, in U.S. Pat. No. 6,223,559 (2001), teaches a medical identification charm bracelet to which are affixed individual display devices, or charms. Each charm contains an electronic circuit which, upon activation, draws attention to the bracelet and provides information about a particular medical condition of the wearer. Each charm is individually activated. If more than one charm were activated at a time, two or more charms would deliver their information simultaneously, resulting in confusion on the part of the user.

In U.S. Pat. No. 6,253,971 (2001) Ohlund teaches an illuminated piece of jewelry. Batteries supply power to a light source positioned near a transparent, ornamental element. The batteries are located in a case at the back of the wearer's neck. The ornament hangs from a pair of flexible conductors which extend from the battery case, around each side of the wearer's neck, terminating at the light source on the ornament. While this piece of jewelry creates interest by being illuminated, it does not provide information such as the time of day.

Clark, in U.S. Pat. No. 4,185,283 ((1980) and U.S. Pat. No. 4,444,515 (1984), shows timepieces (a pedestal clock and an earring watch) with sequentially activated chiming or visible indications for hours, tens of minutes, and minutes, but these timepieces have relatively low aesthetic attractiveness. Their disclosures are incorporated by reference.

OBJECTS AND ADVANTAGES

Accordingly, several objects and advantages of the present invention are to provide improved decorative items of jewelry, and an improved timekeeping device which reveals the time of day at a glance, which contains a plurality of elements which deliver information cooperatively, and which provides useful information in addition to optionally being illuminated and attractive.

Additional objects and advantages will become apparent from a consideration of the drawings and ensuing description thereof.

SUMMARY

In accordance with the present invention, a method, apparatus, and system are provided for providing three-dimensional, curved, active electronic displays, including those for indicating the time of day. Individual elements which display seconds, minutes, and hours are assembled into a decorative bracelet or necklace. The time of day is determined by noting the hours on one element, the tens of minutes on a second element, the minutes on a third element, and the seconds on a fourth element.

Figure 1:
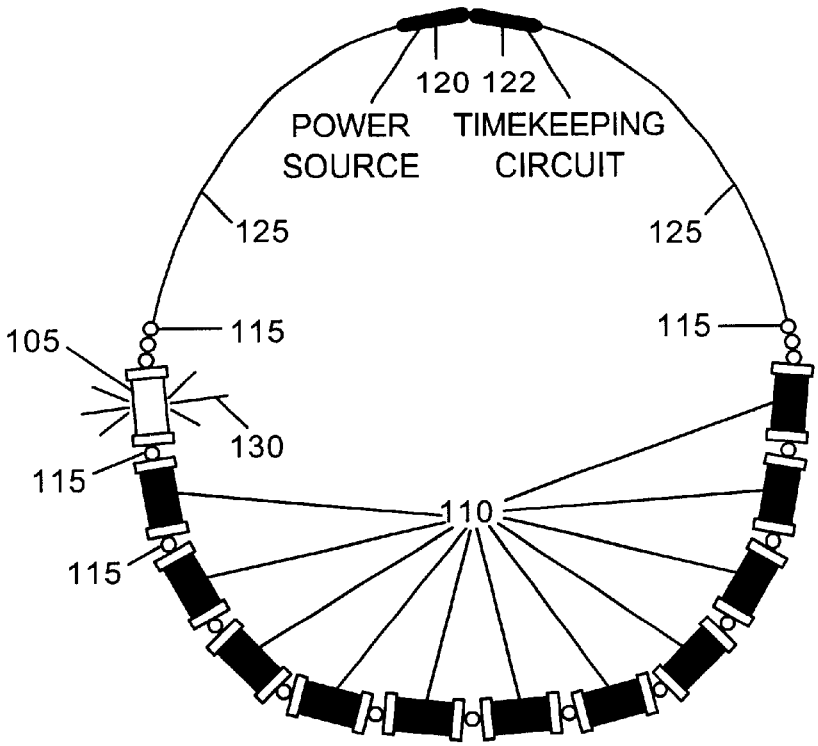
FIGS. 1 and 1B show a frontal view of a necklace with twelve beads, indicating the 1 o'clock and 2 o'clock hours, in accordance with the invention.

| DRAWING FIGURE REFERENCE NUMERALS | |
|---|---|
| 105 | Display bead ON |
| 110 | Display bead OFF |
| 115 | Flexible joint member |
| 120 | Non-display bead, power source |
| 122 | Bead with timekeeping circuit |
| 125 | Leads |
| 130 | Light ray |
| 200 | Display bead |
| 205 | Display portion |
| 210 | End bell |
| 300 | Alternative bead design |
| 405 | Lead |
| 410 | Lead |
| 415 | Lead |
| 417 | Integrated circuit |
| 420 | Lead |
| 425 | Lead |
| 430 | Lead |
| 435 | Lead |

-continued

| DRAWING FIGURE REFERENCE NUMERALS | |
|---|---|
| 440 | Lead |
| 445 | Display segment |
| 450 | Display segment |
| 455 | Display segment |
| 460 | Display segment |
| 465 | Cover |
| 505 | Display bead ON |
| 510 | Display bead OFF |
| 600 | Segmented display bead |
| 605 | Display segment |
| 610 | Display segment |
| 615 | Display segment |
| 620 | Display segment |
| 700 | Bar graph display bead |
| 705 | Display portion |
| 805 | Hours display bead |
| 810 | Tens of minutes display bead |
| 815 | Minutes display bead |
| 820 | Seconds display bead |
| 905 | Hours display bead |
| 910 | Tens of minutes display bead |
| 915 | Minutes display bead |
| 920 | Seconds display bead |
| 1005 | Hours display bead |
| 1010 | Tens of minutes display bead |
| 1015 | Minutes display bead |
| 1020 | Seconds display bead |

DETAILED DESCRIPTION

First Preferred Embodiment—FIG. 1

In accordance with a first preferred embodiment of the invention, a necklace, shown in FIG. 1 comprises a power source such as a battery in a non-displaying bead 120, another non-displaying bead 122 containing a timekeeping circuit, and twelve beads comprising binary (ON or OFF) display stations 105 (ON) and 110 (OFF) to indicate the hours one through twelve. The power source and timekeeping circuitry are well-known to those skilled in the art of electronic timepieces. Beads 120 and 122 also serve as a fastener to close the loop of the necklace.

ON bead 105 and OFF beads 110, comprising individual timekeeping display stations, are electrically and mechanically connected with flexible joint members 115. Electrical power and timekeeping signals are conveyed to beads 105 and 110 via cable or lead 125, containing three flexible conductive leads 405, 410, and 415 (FIG. 4) which complete the loop of the necklace. The three leads of cable 125 are twisted or braided decoratively (not shown) or are covered by an attractive sheath (not shown). As will be apparent, each bead can move with respect to its adjacent beads and the string of individual beads is flexible and bendable. Upon receiving an electrical signal from the timekeeping circuitry, beads 105 and 110 change appearance, as described below in connection with FIGS. 2A through 4.

Figure 1B:
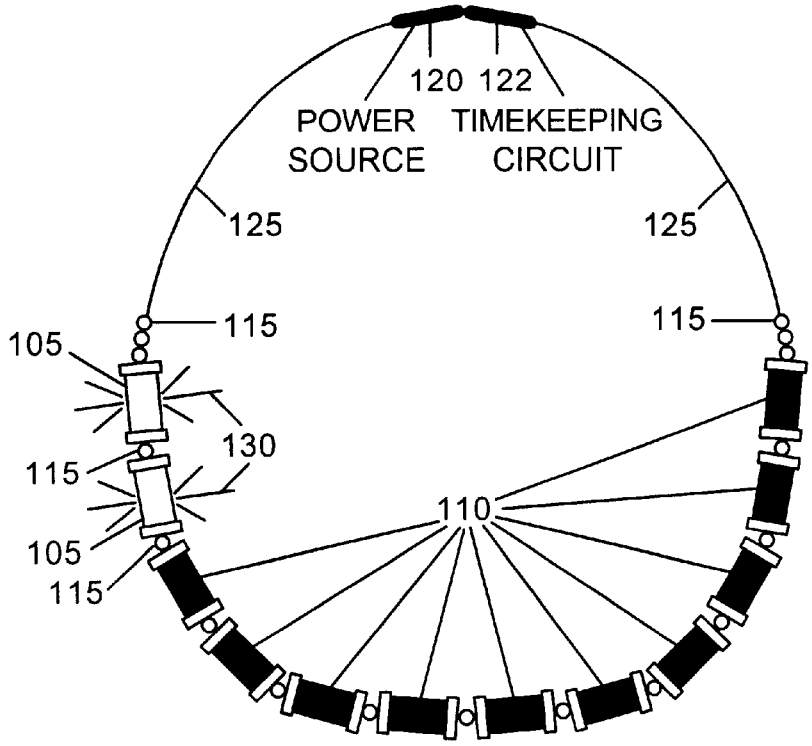

Operation—FIGS. 1 and 1B

The necklace of FIG. 1 is configured to display the hour of the day by causing one additional bead at a time to have an appearance which is different from the remaining beads. In FIG. 1A, first bead 105 is in an ON condition, while the remaining eleven beads 110 are in an OFF condition. The necklace thus indicates that the time-of-day is in the one o'clock hour. During the two o'clock hour, two beads are in the ON condition, as shown in FIG. 1B, and so forth. Thus the wearer of the necklace, or anyone nearby, can easily tell the hour by counting the number of beads that are ON; i.e., the number of ON beads equals the hour of the day. (Alternatively, since the first bead can be readily identified, the necklace can be arranged to cause only one bead at a time to be different, so that the hour can be determined by counting up to the differently illuminated bead.)

Description—Display Beads—FIGS. 2A through 4

Figure 2A:
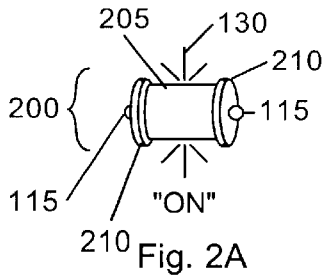
FIGS. 2A and 2B show perspective views of a single bead display element in the ON, or light-emitting, and OFF, or dark states, respectively.
Figure 2B:
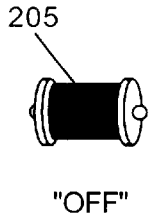

FIGS. 2A, 2B, 3A, and 3B show two different shapes of binary display beads which can be used in the necklace of FIG. 1 in ON and OFF conditions. FIGS. 2A and 2B show one of the beads of FIG. 1 in detail. It comprises a cylindrical display portion 205, two end flanges or bells 210 rigidly attached to the ends of display portion 205, and at least one spherical joint and spacing member 115, rigidly attached to the outside of right end bell 210. Joint member 115, which permits the necklace to bend, preferably is a solid sphere which has a through hole (not shown) to accommodate cable 125 (FIG. 1) which mechanically and electrically connects the beads.

Display portion 205 comprises a liquid crystal (LC) with an optional internal lamp, a light-emitting diode (LED), an organic light-emitting diode (OLED), an electroluminescent (EL) device, or other optically sensible display modality which is responsive to electrical stimulation. These display technologies are well-known to those skilled in the art of electronics.

Upon receiving an activating signal from the timekeeping electronics, display portion 205 changes appearance. It preferably changes between dark (FIG. 2B) and light (FIG. 2A), but may also change between one color and another, flashing to non-flashing, and so forth, depending on the design and technology chosen. Light rays 130 (FIGS. 1 and 2A) indicate the ON state or condition of a luminant display bead or portion thereof.

Figure 3A:
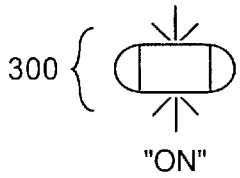
FIGS. 3A and 3B show an alternative bead display element in the ON and OFF states, respectively.
Figure 3B:
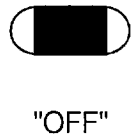

FIGS. 3A and 3B show an alternative bead design 300 in the ON and OFF conditions, respectively. The bead of FIG. 3 has no flanges, but instead has rounded or curved end portions which do not lighten and darken. When the bead is ON, its cylindrical central portion is light in color or light-emitting (FIG. 3A) while when OFF (FIG. 3B) the bead is dark. These roles can be reversed if desired. Due to their rounded ends, no spherical spacer beads (115 in FIG. 4) need be used between adjacent beads in FIG. 3.

Figure 4:
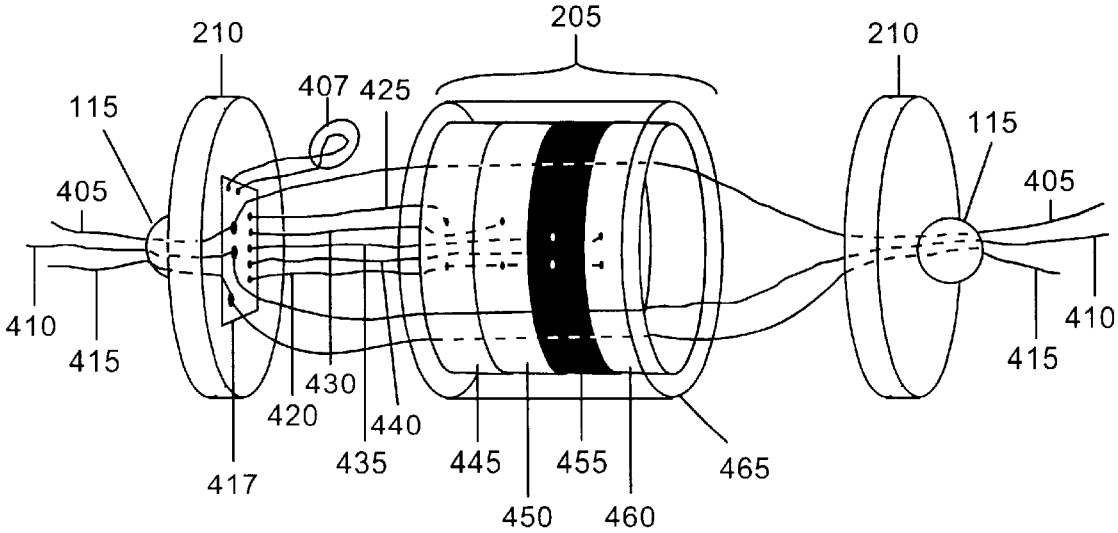
FIG. 4 shows an exploded view of a display bead and circuit used in the previous embodiments and others.

FIG. 4 shows the construction of another alternative display bead comprising four display segments 445, 450, 455, and 460. Although four segments are shown, fewer or more are used, as required. In the beads shown in FIGS. 2 and 3, only a single segment is used. Display segments 445, 450, 455, and 460 are preferably LC devices, but may alternatively be LED, OLED, EL, or another display modality. The multiple layers which constitute an LC, LED, OLED, or EL are not shown but are well known and are curved and are contained within a transparent protective cover 465.

A lamp 407, which can be either an incandescent or solid-state lamp, is used when the display type is transmissive, as in the case of a transmissive LC display. Reflective LC displays are viewed in ambient light and require no additional illumination. LEDs, OLEDs, and EL displays emit light and therefore require no additional illumination.

Conductors 405 and 415 carry power and power return, respectively, from non-displaying bead 120 Conductor 410 carries timekeeping signals from non-displaying bead 122. The return paths for timekeeping signals and power share return conductor 415. Leads 405, 410, and 415 convey power and signals to all indicating parts of the necklace. In this embodiment, timekeeping signals are conveyed on conductor 410 by a serial communications protocol, well-known to those skilled in the art of electronics. These signals are applied to an integrated circuit (IC) 417 in each bead. The serial data actuate each IC 417 individually, according to the address of the bead. The timekeeping circuit in bead 122 provides power, ground, and a serial data signal on leads 405, 410, and 415, respectively, to all display heads. Within each display bead, the outputs 420, 425, 430, 435, and 440 of IC 417 selectively energize lamp 407, if present, and each of display segments 445, 450, 455, and 460. Timekeeping signals transmitted along data line 410 cause individual ICs 417 to activate display segments 445, 450, 455, and 460 via leads 420, 425, 430, 435, and 440 (and power return 415) and lamp 407 (if present) according to a code which displays the time of day. Time-of-day displays are discussed in more detail below.

In the case of the necklace of FIG. 1, leads 405, 410, and 415 supply power, signal, and ground to all beads. Each bead contains only one display element, similar to element 445 (FIG. 4), which occupies the entire display space of the bead (not shown). At the start of the one o'clock hour, the timekeeping circuitry in bead 122 transmits a serial communications signal on data line 410 which selects IC 417 within bead 105, FIG. 1A. IC 417 in bead 105 energizes display element 445 through leads 420 and 425, causing it to change color or to emit light. Alternatively, lamp 407 may be energized by IC 417, depending on the display type used. The remaining IC 417s in beads 110 are each selected one at a time, and caused to keep their associated display elements in a de-energized state. Thus, the electronic signal will cause bead 105 to be different in appearance from beads 110.

At the start of the two o'clock hour, the timekeeping circuitry in bead 122 transmits a serial communications signal on data line 410 which selects IC 417 within first and second beads 105, FIG. 1B, energizing the display elements within those beads. The signals select the remaining IC 417s in beads 110 one at a time, causing them to keep their associated elements in a de-energized state. Thus, during the two o'clock hour two beads 105 differ in appearance form the remaining beads 110. This progression continues until all twelve beads are energized, whereafter, at 1:00, only the first bead is again energized.

Other serial protocols are available. Again, these protocols are well known to those skilled in the art of electronics and need not be discussed in detail here for an artisan to fully understand the present invention.

Figure 5:
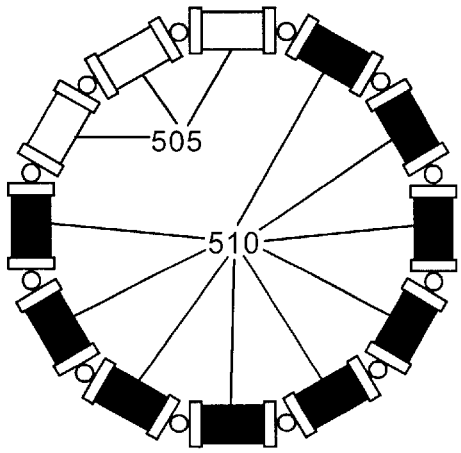
FIG. 5 shows a bracelet comprising twelve bead display elements, at the 3 o'clock hour with three beads in the ON state and the remainder in the OFF state.
Figure 6:
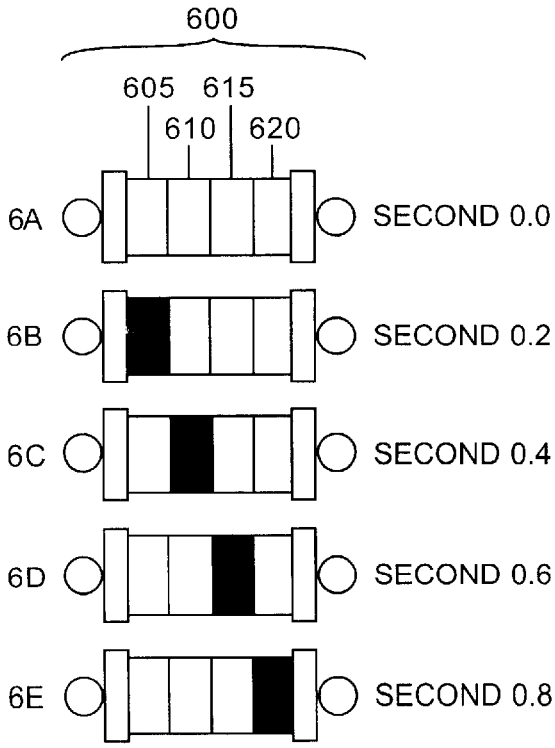
FIGS. 6A–6E show an alternative bead displaying seconds in 2/10-second increments as a moving segment.

Description—Second Preferred Embodiment—FIG. 5—Bracelet

FIG. 5 shows a bracelet that is constructed in a manner similar to the necklace of FIG. 1. The power source and timekeeping circuitry, described above, for the bracelet are contained within one or more of beads 505–510.

Operation—Second Preferred Embodiment—FIG. 5—Bracelet

The bracelet contains twelve beads to indicate the hours one through twelve. As with the preferred arrangement of the necklace of FIG. 1, the number of beads which are differently illuminated is used to provide the hour indication. In this example, three beads 505 are ON, the remaining nine beads 510 are OFF, thus indicating the 3 o'clock hour. (As with the embodiment of FIG. 1, if the bracelet has a reference point, such as a clasp or differently colored bead, then only one bead can be illuminated for each hour and the numeric position of the differently illuminated bead can be counted to determine the number of the hour.)

Description—Alternative Display Bead Designs—FIGS. 6A through 7E

FIGS. 6A through 6E show an alternative design of a segmented bead 600 using the circuit of FIG. 1. Display bead 600 has three circumferential lines which define four segments or bands 605, 610, 615, and 620 which can be individually addressed by the timekeeping circuitry to form a moving band display. FIG. 6A shows display 600 at the beginning or zero$^{th}$ increment of a second of time; all segments 605, 610, 615, and 620 are in the OFF condition. The bands are illuminated progressively, one at a time, so that in FIG. 6B, at 0.2 second, band 605 is in the ON condition and bands 610–620 are OFF. In FIG. 6C, at 0.4 second, band 605 is OFF, band 610 is ON, and bands 615 and 620 are OFF, and so forth in FIGS. 6D and 6E. At the end of the one second interval, the appearance of display 600 repeats, resuming at FIG. 6A. Fractional seconds are used in this example, but a similar progression can also be used for the other parameters of the time of day, including the tens of minutes and hours.

FIGS. 7A through 7E show another alternative bead 700 comprising a bar-graph display that fills progressively in steps from one end to the other. Bead 700 is similar to bead 600, but has no circumferential lines. FIG. 7A shows display 705 of bead 700 at the zero$^{th}$ increment of a second of time with all portions of display 705 OFF. In FIG. 7B, at 0.2 second, one-fourth of display 705 is in the ON condition, while three fourths are OFF. FIG. 7C shows display 705 at 0.4 second with half of display 705 ON and half OFF. FIG. 7D shows display 705 at 0.6 second with three-fourths of display 705 ON and one-fourth OFF. Finally, FIG. 7E shows display 705 at 0.8 second, with all portions ON. At the end of the one-second interval, the appearance of display 700 repeats, resuming in the state shown in FIG. 7A. As above, fractional seconds are used in this example, but a similar progression can also be used for the other parameters of the time of day, including the minutes and hours.

Figure 8:
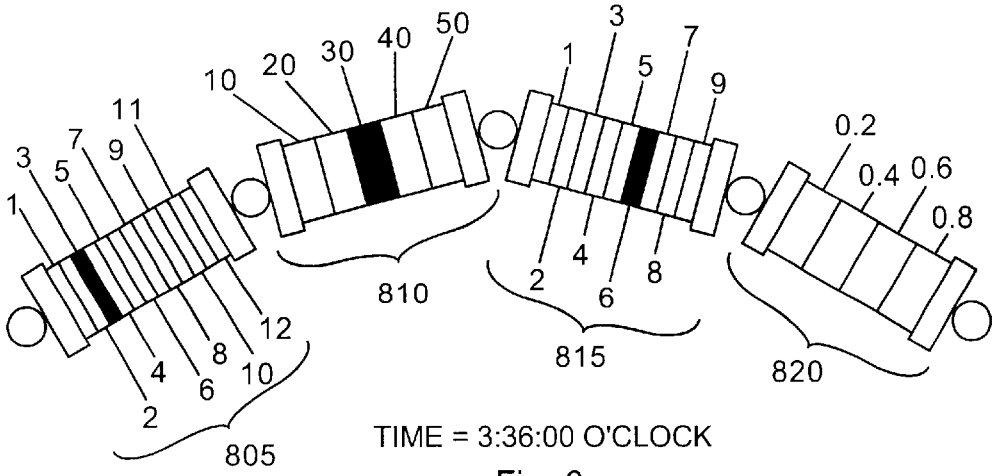
FIG. 8 shows four beads for a bracelet or necklace and arranged in a row for telling the time of day.
Figure 9:
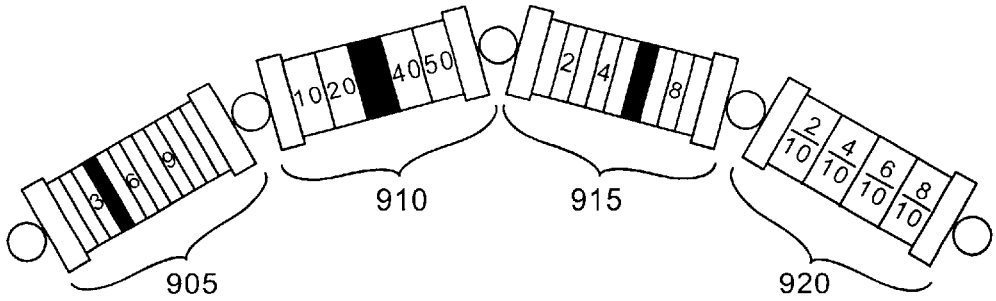
FIG. 9 shows four beads comprising displays with numeric indicators.
Figure 10:
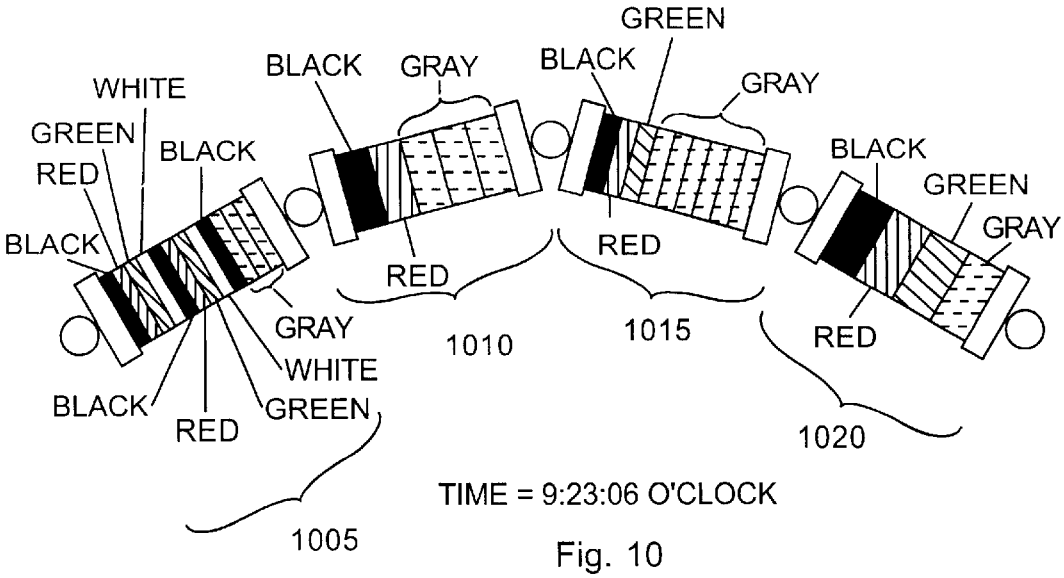
FIG. 10 shows four beads comprising colored displays.

Alternative Display Embodiments—FIGS. 8 through 10—Necklace or Bracelet

Figure 7:
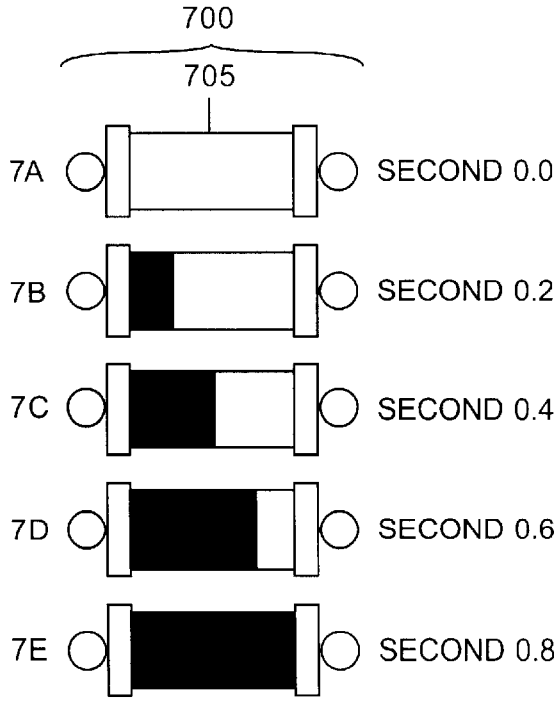
FIGS. 7A–7E shows a second alternative bead displaying seconds at 2/10-second increments as a bar graph.

FIG. 8 shows a timepiece comprising four display beads. Timepiece 800 can be part of a necklace, a bracelet, or can be a complete piece of jewelry, such as a brooch or pendant. Display bead 805 contains twelve bands, one for each hour of the day. Bead 810 contains five bands, one for each ten-minute increment of an hour. Bead 815 contains nine bands, one for each minute. The display on each of beads 805, 810, and 815 progresses as described above in connection with FIG. 6. Alternatively, the display on each of beads 805–815 can progress as shown in FIG. 7. The time displayed in this example is 3:36:00 o'clock. The beads of FIG. 8 each contain their own dedicated IC (not shown), similar to IC 417 of FIG. 4, but with either 12, 6, 10, or 5 leads, or another number, as required for the particular display used.

Seconds are displayed by bead 820. The seconds display can optionally alternate between ON and OFF conditions, as shown in FIGS. 2 and 3, or a more detailed display can be used such as with beads 805, 810, and 815.

The timepiece in FIG. 9 is similar to that in FIG. 8, except that the bands on display beads 905, 910, 915, and 920 are inscribed with temporal numbers which indicate the hour, tens of minutes, and seconds. Because of space, only some of the hour, tens of minutes, and minutes need be shown. Bead 920 can be made in a similar fashion, or simply alternate between ON and OFF conditions, as shown in FIGS. 2 and 3. The time displayed in this example is 4:36:00 o'clock.

The timepiece in FIG. 10 employs bands of color. Display beads 1005, 1010, 1015, and 1020 display bands in repeating patterns of black, red, green, and white bands on a gray background. Bead 1005 contains 12 segments. At 1:00, left-most bead 1006 is black and all remaining bands on bead 1005 are gray. At 2:00, left-most bead 1006 is black, adjacent bead 1007 is red, and the remaining 10 bands are gray, and so forth. Bead 1010 employs the same repeating pattern to display tens of minutes, and bead 1015 employs the same repeating pattern for minutes. Bead 1020 can optionally employ the same color pattern for seconds, or simply change colors once each second. The beads of FIGS. 9 and 10 are driven and wired similarly to FIG. 8 and the previous figures. The beads of FIG. 10 are preferably made of glass or plastic and the different bands are colored by the action of the display medium.

SUMMARY, RAMIFICATIONS, AND SCOPE

It is thus seen that the present method and apparatus provide a system for timekeeping that is novel, attractive, and decorative. The time of day can be told at a glance from any of the embodiments, no confusion results from having a plurality of display beads active at the same time, and substantial information is available from a display modality which can optionally be illuminated. Depending on the design used, the apparatus can be viewed with or without ambient light.

While the above description contains many specificities, it will be apparent that the invention is not limited to these and can be practiced with other parameters and materials. Numerous other bead designs can be employed. Bead shapes and cross-sections can be rectangular, triangular, pentagonal, hexagonal, irregular, and so forth. Display modalities can be mixed within a bead or within a timepiece. The beads of FIGS. 1 and 5 can be numbered with the hours of the day and 24 beads can be provided to indicate time in the military-European format. For example OLEDs can be used with LCs and LEDs. Instead of displaying the time of day, the system can be used to display temperature or other information. Instead of being worn as a necklace or bracelet, the apparatus can be worn as an armband, headband, waistband, leg band, anklet, or pendant. Display beads can be rigidly joined, made in different sizes, or spaced by non-displaying beads. Instead of only three interconnecting wires, more or fewer can be used and a Universal Serial Bus, an RS-232 bus, and various other serial connections and protocols can be used. Instead of a serial connection, a parallel connection can be used. Instead of an integrated circuit in each bead, a single integrated circuit (IC) can be used in the timekeeping bead, with wires interconnecting the single IC and each display bead. The necklace or bracelet can also be made to provide an audible indication. Instead of a timepiece, the inventive principle can be implemented in non-horologic jewelry, i.e., multiple curved LC display stations can be dynamically and sequentially activated without displaying any numeric information and without any timekeeping function. The mere sequential dynamic activation of the beads will create an attractive, decorative, and unique jewelry effect.

Accordingly the scope of this invention should be determined, not by the embodiments illustrated, but by the appended claims and their legal equivalents.

I claim:

1. An electronic display comprising:

a serial plurality of electronic display stations, each of said of electronic display stations in said serial plurality comprising an individual bead, so as to provide a serial plurality of individual beads, each bead having at least two different visual states a flexible cable connecting said serial plurality of individual beads electronically and mechanically so that adjacent beads are connected by said cable so as to form a series, chain, or string of said individual beads, and such that each bead can move with respect to its adjacent beads and said sting of said individual beads is flexible and bendable, a power source and a control circuit arranged to send signals via said cable to said serial plurality of individual beads so as to activate said different visual states of said beads in a dynamic manner so that they collectively and continually visually display the time elapsed from a given time, thereby to provide a flexible serial string of individual beads that indicates the time.

2. The electronic display of claim 1 wherein said control circuit is arranged to activate said beads so that they display the numbers of hours elapsed from a given time.

3. The electronic display of claim 1 wherein said series, chain, or string of said individual beads forms an item of jewelry selected from the class consisting of a bracelet and a necklace.

4. The electronic display of claim 1 wherein each of said beads is an electronic liquid-crystal display station.

5. The electronic display of claim 1 wherein said control circuit is arranged to activate said beads sequentially so that they collectively display the hour of day.

6. The electronic display of claim 5 wherein said control circuit is arranged to activate said beads one at a time.

7. The electronic display of claim 1 wherein said control circuit is arranged to activate said beads simultaneously when the time elapsed is greater than one unit of time so that they collectively display said time elapsed when said time elapsed is greater than one unit of time.

8. The electronic display of claim 1 wherein, in said serial plurality of individual beads, adjacent beads are spaced apart.

9. The electronic display of claim 7 wherein adjacent beads are spaced apart by a solid spacer.

10. The electronic display of claim 1 wherein, in said serial plurality of individual beads, adjacent beads are contiguous.

11. The electronic display of claim 1 wherein said power source and said control circuit are part of at least one of said beads.

12. The electronic display of claim 1 wherein said power source and said control circuit are in at least one bead that is separate from said serial plurality of individual beads.

13. The electronic display of claim 1 wherein said two different visual states of each of said display stations is selected from the class consisting of (a) an on and an off state and (b) different colors.

14. The electronic display of claim 1 wherein each of said beads has at least four different areas and said electronic circuit is arranged to activate said different areas sequentially so that said different areas collectively display the time elapsed from a given time.

15. The electronic display of claim 14 wherein said different areas of one of said beads correspond to the respective units of one time quantity selected from the class consisting of hours, tens of minutes, minutes, and seconds, and said different areas of another of said beads correspond to the respective units of another time quantity selected from the class consisting of hours, tens of minutes, minutes, and seconds, and said control circuit is arranged to activate said different areas of said beads so that they collectively the respective time quantity to which they correspond.

16. The timekeeping device of claim 1 wherein said display stations are selected from the class consisting of liquid-crystal devices, light-emitting diodes, organic light-emitting diodes, and electroluminescent devices.

17. A timekeeping device, comprising:

a power source, a timekeeping circuit, a serial plurality of binary display stations connected electrically and mechanically to said power source and to said timekeeping circuit, each of said of electronic display stations in said serial plurality comprising an individual bead, so as to provide a serial plurality of individual beads, a flexible cable connecting said serial plurality of individual beads electronically and mechanically so that adjacent beads are connected by said cable so as to form a series, chain, or string of said individual beads, and such that each bead can move with respect to its adjacent beads and said string of beads is flexible and bendable, each of said beads having at least two different visual states, said timekeeping circuit being arranged to send signals on said cable that activate said individual beads sequentially so that their different visual states display the time elapsed from a given time, and so that a count of the number of beads having a similar visual state will indicate said time elapsed thereby to provide a flexible serial string of individual beads that indicates the time.

18. A method for indicating the time, comprising:

providing a series of electronic display stations, each of said electronic display stations in said series comprising an individual bead, so as to provide a serial plurality of individual beads, each of said beads having at least two different visual states connecting said serial plurality of individual beads electronically and mechanically with a flexible cable so as to form a series, chain, or string of said individual beads, said series, chain, or string of said individual beads being arranged so that adjacent beads are connected electronically and mechanically by said cable, and such that each bead can move with respect to its adjacent beads, and said string of beads is flexible and bendable, activating said different visual states of said bead in a dynamic manner so that they collectively and continually visually display the time elapsed from a given time, thereby to provide a serial string of individual beads that indicates the time and that also can be deployed as a flexible serial item.

19. A timekeeping device, comprising:

a power source, a timekeeping circuit, a serial plurality of segmented display stations connected electrically and mechanically to said power source and said timekeeping circuit, each of said of segmented display stations in said serial plurality comprising an individual bead, so as to provide a serial plurality of individual beads, each of said individual beads having at least two segments that each has at least two different visual states, a flexible cable connecting said serial plurality of individual beads electronically and mechanically so that adjacent beads are connected by said cable so as to form a series, chain, or string of said individual beads, and such that each bead can move with respect to its adjacent beads and said string of beads is flexible and bendable, said timekeeping circuit being arranged to activate, via said cable, said different visual states of said segments of said plurality of individual beads so that said segments of said plurality of individual beads collectively and continually the time elapsed from a given time, thereby to provide a serial string of individual beads that each has segments that indicate the time and such that said serial string also can be deployed as a flexible serial item.

20. A method for telling time, comprising:

providing a power source, a timekeeping circuit, and a plurality of electronic display stations, each of said electronic display stations comprising an individual bead, so as to provide a plurality of individual beads, each of said individual beads having at least two segments that each has at least two different visual states, connecting said power source, said timekeeping circuit and said plurality of individual beads electrically and mechanically with a flexible cable so as to form a series, chain, or string of said individual beads, said series, chain, or string of said individual beads being arranged so that adjacent beads are connected electronically and mechanically by said cable, and such that each bead can move with respect to its adjacent beads, and said string of beads is flexible and bendable, activating said different visual states of said segments of said beads individually in a dynamic manner via said cable so that said segments of said plurality of individual beads collectively and continually the time elapsed from a given time, thereby to provide a serial string of individual beads that each has segments that indicate the time and such that said serial string also can be deployed as a flexible serial item.

* * * * *

UNITED STATES PATENT AND TRADEMARK OFFICE

CERTIFICATE OF CORRECTION

PATENT NO. : 6,711,101 B2
DATED : March 23, 2004
INVENTOR(S) : Navot Bornovski

It is certified that error appears in the above-identified patent and that said Letters Patent is hereby corrected as shown below:

Column 8,
Line 13, change “sting” to -- string --.

Signed and Sealed this

Twenty-ninth Day of June, 2004

JON W. DUDAS
*Acting Director of the United States Patent and Trademark Office*